US011840770B2

(12) United States Patent
Kato et al.

(10) Patent No.: US 11,840,770 B2
(45) Date of Patent: Dec. 12, 2023

(54) FILM FORMATION APPARATUS AND FILM FORMATION METHOD FOR FORMING METAL FILM

(71) Applicant: TOYOTA JIDOSHA KABUSHIKI KAISHA, Toyota (JP)

(72) Inventors: Akira Kato, Toyota (JP); Haruki Kondoh, Okazaki (JP); Soma Higashikozono, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/523,591

(22) Filed: Nov. 10, 2021

(65) Prior Publication Data

US 2022/0154362 A1 May 19, 2022

(30) Foreign Application Priority Data

Nov. 19, 2020 (JP) ..... 2020-192288

(51) Int. Cl.
*C25D 17/00* (2006.01)
*C25D 17/10* (2006.01)

(52) U.S. Cl.
CPC ..... *C25D 17/002* (2013.01); *C25D 17/10* (2013.01)

(58) Field of Classification Search
None
See application file for complete search history.

(56) References Cited

U.S. PATENT DOCUMENTS 6,228,231 B1 * 5/2001 Uzoh ..... C25D 17/001 204/286.1
2003/0079683 A1 5/2003 Nakano et al.
2014/0144781 A1 * 5/2014 He ..... C25D 17/007 204/229.4
2021/0010147 A1 * 1/2021 Takahashi ..... C25D 17/002
2021/0161038 A1 * 5/2021 Yao ..... H01Q 1/40

FOREIGN PATENT DOCUMENTS

| | | | | |
|---|---|---|---|---|
| CN | 101275267 A | | 10/2008 | |
| DE | 195 20 458 A1 | | 12/1996 | |
| EP | 0745702 | * | 12/1996 | ..... C25D 13/22 |
| JP | H07-188975 A | | 7/1995 | |
| JP | 2003-129294 A | | 5/2003 | |
| JP | 2014-051701 A | | 3/2014 | |
| JP | 2017-88918 A | | 5/2017 | |
| JP | 2018-35426 A | | 3/2018 | |

OTHER PUBLICATIONS

English translation WO 2011066569. (Year: 2011).*

* cited by examiner

*Primary Examiner* — Stefanie S Wittenberg
(74) *Attorney, Agent, or Firm* — Oliff PLC

(57) ABSTRACT

A film formation apparatus for forming a metal film includes an anode, a solid electrolyte membrane disposed between the anode and a substrate that serves as a cathode, a power supply device that applies a voltage between the anode and the cathode, a solution container that contains a solution between the anode and the solid electrolyte membrane, the solution containing metal ions, and a pressure device that pressurizes the solid electrolyte membrane to the cathode side with a fluid pressure of the solution. The film formation apparatus includes an auxiliary cathode disposed in a peripheral area of the film formation region when the surface of the substrate is viewed in plain view, the auxiliary cathode having an electric potential lower than an electric potential of the anode.

8 Claims, 12 Drawing Sheets

| Objective Variable | Predicted Value |
|---|---|
| Current Density Variation | 0.195 |
| | |
| Explanatory Variable | Level |
| P-A Distance | 1.0156 |
| B-C Distance | 0.1000 |
| C-D Distance | 0.1113 |
| P-Q Distance | 0.2352 |

FILM FORMATION APPARATUS AND FILM FORMATION METHOD FOR FORMING METAL FILM

CROSS REFERENCE TO RELATED APPLICATIONS

The present application claims priority from Japanese patent application JP 2020-192288 filed on Nov. 19, 2020, the entire content of which is hereby incorporated by reference into this application.

BACKGROUND

Description of Related Art

The present disclosure relates to a film formation apparatus and a film formation method for forming a metal film, and especially relates to a film formation apparatus and a film formation method for forming a metal film that allow forming the metal film on a surface of a substrate.

Background Art

Conventionally, there has been known a film formation apparatus and a film formation method in which metal ions are deposited to form a metal film. For example, JP 2014-51701 A proposes a film formation apparatus and a metal film method using the apparatus. The film formation apparatus includes an anode, a solid electrolyte membrane disposed between the anode and a substrate that serves as a cathode, a power supply device that applies a voltage between the anode and the cathode, a solution container that contains a solution containing metal ions between the anode and the solid electrolyte membrane, and a pressure device that pressurizes to the solid electrolyte membrane to the cathode side with a fluid pressure of the solution. The solid electrolyte membrane is disposed to seal an opening in the cathode side of the solution container.

When a metal film is formed on a surface of a substrate by this film formation method for forming a metal film, the solid electrolyte membrane is brought in contact with the surface of the substrate, and subsequently, the metal ions internally contained in the solid electrolyte membrane are deposited by applying a voltage while pressurizing the surface of the substrate by the solid electrolyte membrane with a fluid pressure of a solution, thus forming the metal film on the surface of the substrate.

SUMMARY

In the conventional film formation apparatus and film formation method for forming a metal film, when the metal film is formed on the surface of the substrate, lines of electric force from the anode are locally concentrated in a peripheral edge portion of a film formation region in the surface of the substrate, and a current is concentrated to the peripheral edge portion of the film formation region, thus possibly causing current density variations in the film formation region. Consequently, the metal ions are excessively deposited in the peripheral edge portion of the film formation region in the surface of the substrate, and a film thickness of the metal film increases, thereby possibly failing to form the metal film with a uniform film thickness.

The present disclosure has been made in consideration of such a situation and provides a film formation apparatus and a film formation method for forming a metal film that allow forming the metal film with a uniform film thickness.

To solve the above-described problem, a film formation apparatus for forming a metal film of the present disclosure comprises an anode, a solid electrolyte membrane, a power supply device, a solution container, and a pressure device. The solid electrolyte membrane is disposed between the anode and a substrate that serves as a cathode. The power supply device applies a voltage between the anode and the cathode. The solution container contains a solution between the anode and the solid electrolyte membrane. The solution contains metal ions. The pressure device pressurizes the solid electrolyte membrane to the cathode side with a fluid pressure of the solution. A metal film is formed on a film formation region by applying the voltage while pressurizing the film formation region in a surface of the substrate by the solid electrolyte membrane to deposit the metal ions internally contained in the solid electrolyte membrane. The film formation apparatus further includes an auxiliary cathode disposed in a peripheral area of the film formation region when the surface of the substrate is viewed in plan view. An electric potential of the auxiliary cathode is lower than an electric potential of the anode.

With the film formation apparatus for forming a metal film of the present disclosure, the metal film can be formed with a uniform film thickness.

Furthermore, a film formation method for forming a metal film of the present disclosure comprises disposing a solid electrolyte membrane between an anode and a substrate that serves as a cathode, forming a metal film on a film formation region by applying a voltage between the anode and the cathode while pressurizing the film formation region in a surface of the substrate by the solid electrolyte membrane with a fluid pressure of a solution to deposit metal ions internally contained in the solid electrolyte membrane. The solution is disposed between the anode and the solid electrolyte membrane. The solution contains the metal ions. The metal film is formed by applying the voltage in a state where an auxiliary cathode an electric potential of which is lower than an electric potential of the anode is disposed in a peripheral area of the film formation region when the surface of the substrate is viewed in plan view.

With the film formation method for forming a metal film of the present disclosure, the metal film can be formed with the uniform film thickness.

Effect

With the present disclosure, the metal film can be formed with the uniform film thickness.

DETAILED DESCRIPTION OF THE EMBODIMENTS

The following describes embodiments of a film formation apparatus and a film formation method for forming a metal film according to the present disclosure.

Figure 1:
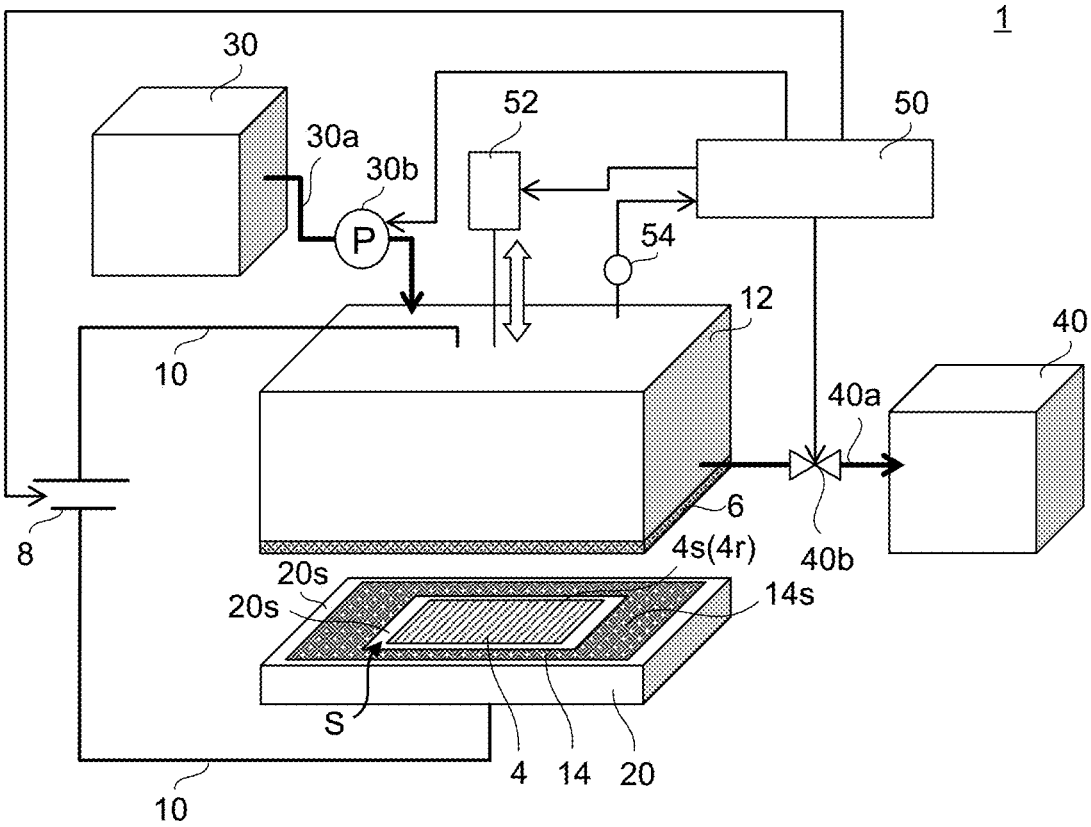
FIG. 1 is a schematic perspective view illustrating a film formation apparatus for forming a metal film according to a first embodiment.
Figure 2A:
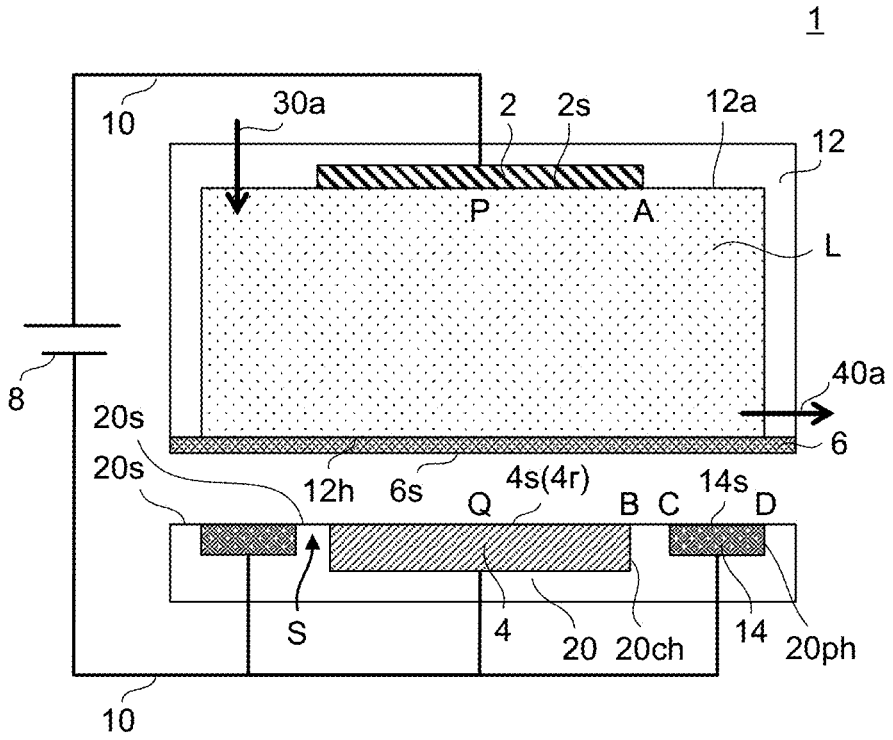
FIG. 2A is a schematic process cross-sectional view illustrating a film formation method for forming a metal film according to the first embodiment.
Figure 2B:
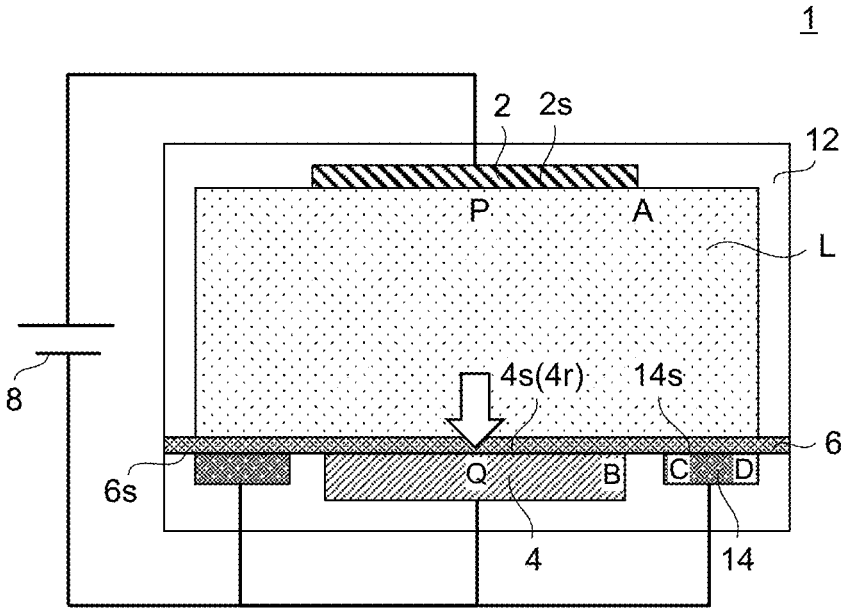
FIG. 2B is a schematic process cross-sectional view illustrating the film formation method for forming a metal film according to the first embodiment.
Figure 2C:
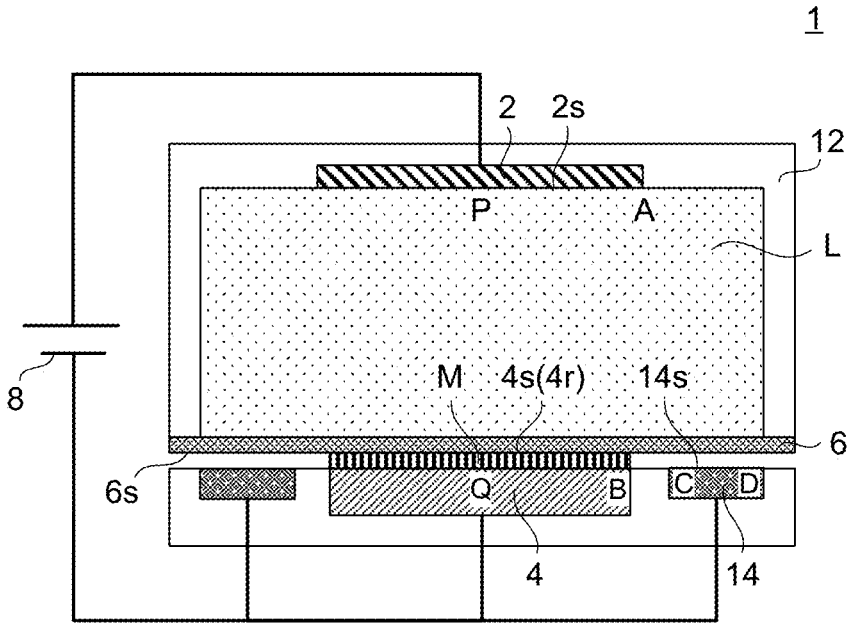
FIG. 2C is a schematic process cross-sectional view illustrating the film formation method for forming a metal film according to the first embodiment.
Figure 3:
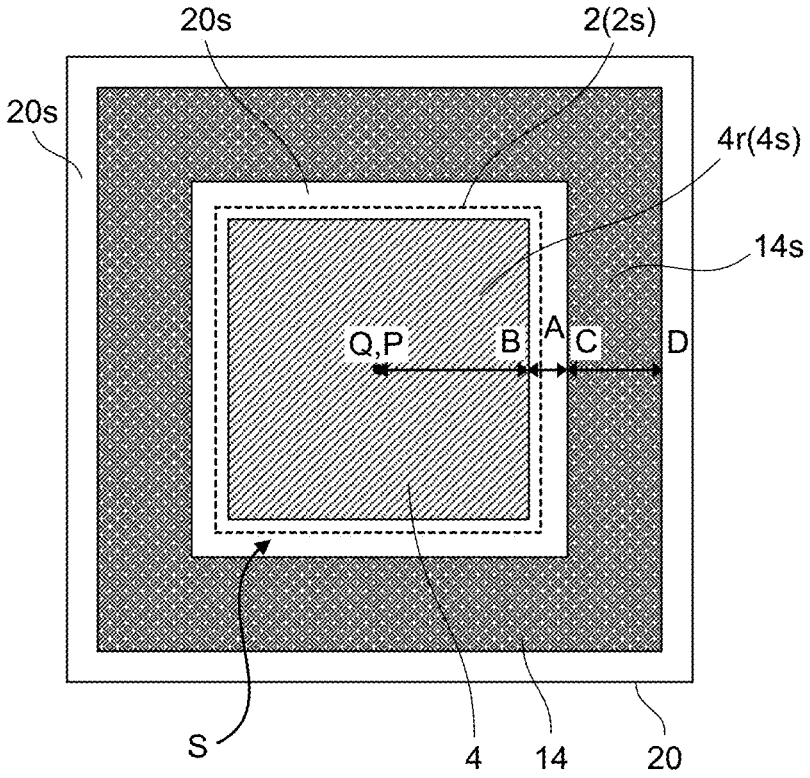
FIG. 3 is a schematic plan view when a surface of a substrate and a surface of an auxiliary cathode of the film formation apparatus illustrated in FIG. 1 are viewed in plan view and is a drawing illustrating a shape of an anode by a dashed line.

First, the embodiment will be schematically described with a film formation apparatus and a film formation method for forming a metal film according to a first embodiment as an example. FIG. 1 is a schematic perspective view illustrating the film formation apparatus for forming a metal film according to the first embodiment. FIG. 2A to FIG. 2C are schematic process cross-sectional views illustrating the film formation method for forming a metal film according to the first embodiment, and FIG. 2A illustrates a schematic cross-sectional surface of a main part including a solution container and a substrate of the film formation apparatus illustrated in FIG. 1. FIG. 3 is a schematic plan view when a surface of the substrate of the film formation apparatus and a surface of an auxiliary cathode illustrated in FIG. 1 are viewed in plan view, and is a drawing illustrating a shape of an anode by a dashed line.

As illustrated in FIG. 1 and FIG. 2A, a film formation apparatus 1 for forming a metal film according to the first embodiment includes an anode 2, a solid electrolyte membrane 6, a power supply device 8, a solution container 12, and a pump (pressure device) 30*b*. The solid electrolyte membrane 6 is disposed between the anode 2 and a substrate 4 that serves as a cathode. The power supply device 8 applies a voltage between the anode 2 and the substrate (cathode) 4. The solution container 12 contains a solution (hereinafter referred to as a "metal ion solution" in some cases) L containing metal ions between the anode 2 and the solid electrolyte membrane 6. The pump (pressure device) 30*b* pressurizes the solid electrolyte membrane 6 to the cathode side with a fluid pressure of the metal ion solution L. In the first embodiment, an entire surface 4*s* of the substrate 4 serves as a film formation region 4*r*. The film formation apparatus 1 for forming a metal film further includes an auxiliary cathode 14 disposed into a frame shape in a peripheral area of the film formation region 4*r* when the surface 4*s* of the substrate 4 is viewed in plan view.

The anode 2 is disposed on an upper surface 12*a* inside the solution container 12, is housed within the solution container 12 so as to be in contact with the metal ion solution L, and is electrically connected to the power supply device 8 via a wiring 10. A surface 2*s* of the anode 2 is parallel to an end surface 6*s* in the cathode side of the solid electrolyte membrane 6, and the surface 4*s* of the substrate 4 and a surface 14*s* of the auxiliary cathode 14. The substrate 4 and the auxiliary cathode 14 are buried in a central groove 20*ch* and a peripheral edge groove 20*ph*, respectively, of a pedestal 20, and therefore, the surface 4*s* of the substrate 4, the surface 14*s* of the auxiliary cathode 14, and a surface 20*s* of the pedestal 20 are flush with one another. A clearance S is provided between the substrate 4 and the auxiliary cathode 14. As illustrated in FIG. 3, when the surface 4*s* of the substrate 4 and the surface 14*s* of the auxiliary cathode 14 are viewed in plan view, the anode 2 has a rectangular shape similar to the film formation region 4*r* of the substrate 4, the anode 2 has a size slightly larger than that of the film formation region 4*r*, the surface 2*s* of the anode 2 has a center P corresponds to a center Q of the film formation region 4*r* of the substrate 4, and the surface 2*s* of the anode 2 has a side parallel to a side corresponding to the film formation region 4*r* of the substrate 4. The surface 14*s* of the auxiliary cathode 14 has an inner periphery C and an outer periphery D the shapes of which are rectangular similar to the film formation region 4*r* of the substrate 4. The inner periphery C of the surface 14*s* of the auxiliary cathode 14 has a size slightly larger than that of the anode 2. The center of the inner periphery C and the center of the outer periphery D of the auxiliary cathode 14 correspond to the center Q of the film formation region 4*r* of the substrate 4. A side of the inner periphery C of the auxiliary cathode 14 and a side of the outer periphery D are parallel to a corresponding side of the film formation region 4*r* of the substrate 4.

In the film formation apparatus 1 for forming a metal film, as illustrated in FIG. 1 and FIG. 2A, the substrate (the cathode) 4 and the auxiliary cathode 14 are electrically connected to the power supply device 8 via the wiring 10 in a similar way. The solution container 12 is provided with an opening 12*h* in the cathode side. The solid electrolyte membrane 6 is disposed to cover the opening 12*h* of the solution container 12. The power supply device 8 is electrically connected to a control apparatus 50, and can receive control signal from the control apparatus 50 to control the voltage between the anode 2 and the substrate 4. The pedestal 20 is formed of a material that has an insulation property and a chemical resistance to the metal ion solution.

In the film formation apparatus 1 for forming a metal film, as illustrated in FIG. 1, a solution tank 30 that contains the metal ion solution L is connected to one side of the solution container 12 via a supply pipe 30*a*, and the pump (pressure device) 30*b* is disposed on the supply pipe 30*a*. A waste liquid tank 40 that collects a waste liquid of the metal ion solution L after the film formation is connected to the other side of the solution container 12 via a waste liquid pipe 40*a*, and an on-off valve 40*b* is disposed on the waste liquid pipe 40*a*. The pump 30*b* and the on-off valve 40*b* are electrically connected to the control apparatus 50, and can receive control signal from the control apparatus 50 to control their operations. This configuration of the film formation apparatus 1 allows making the inside of the solution container 12 a closed space to contain the metal ion solution L by closing the on-off valve 40*b*. Driving the pump 30*b* allows supplying the metal ion solution L to the closed space from the solution tank 30 via the supply pipe 30*a*, thereby allowing controlling the fluid pressure of the metal ion solution L contained in the closed space to a desired value. Opening the on-off valve 40*b* allows transmitting the waste liquid of the metal ion solution L after the film formation to the waste liquid tank 40 via the waste liquid pipe 40*a*.

Furthermore, in the film formation apparatus 1 for forming a metal film, a moving apparatus 52 is connected to an upper portion of the solution container 12. The moving apparatus 52 moves the solution container 12 together with the solid electrolyte membrane 6 toward the substrate 4, thereby bringing the solid electrolyte membrane 6 into contact with the film formation region 4*r* in the surface 4*s* of the substrate 4. The moving apparatus 52 is electrically connected to the control apparatus 50, and can receive control signal from the control apparatus 50 to control the operation.

A pressure gauge 54 that measures the fluid pressure of the metal ion solution L contained in the closed space inside the solution container 12 is disposed. The pressure gauge 54 is electrically connected to the control apparatus 50, and can output a fluid pressure value of the metal ion solution L measured by the pressure gauge 54 as a signal.

The control apparatus 50 is electrically connected to the power supply device 8, the pump 30*b* and the on-off valve 40*b*, the moving apparatus 52, and the pressure gauge 54. The control apparatus 50 can output control signal to control the power supply device 8, the pump 30*b* and the on-off valve 40*b*, and the moving apparatus 52, and can receive the fluid pressure value output as the signal from the pressure gauge 54.

In the film formation method for forming a metal film according to the first embodiment, the film formation apparatus 1 for forming a metal film is used to form a metal film M on the film formation region 4*r* in the surface 4*s* of the substrate 4. The following describes the process.

First, as illustrated in FIG. 1, FIG. 2A, and FIG. 3, so as to form a flush surface with the surface 4*s* of the substrate 4, the surface 14*s* of the auxiliary cathode 14, and the surface 20*s* of the pedestal 20, the substrate 4 and the auxiliary cathode 14 are embedded in the central groove 20*ch* and the peripheral edge groove 20*ph*, respectively, of the pedestal 20 to electrically connect the power supply device 8 to the substrate 4 and the auxiliary cathode 14. The solid electrolyte membrane 6 is disposed between the anode 2 and the substrate 4 serving as the cathode and the auxiliary cathode 14. Together with this, an alignment of the substrate 4 with respect to the anode 2 is adjusted. This causes the surface 2*s* of the anode 2 to be parallel to the surface 4*s* of the substrate 4 and the surface 14*s* of the auxiliary cathode 14. As illustrated in FIG. 3, when the surface 4*s* of the substrate 4 and the surface 14*s* of the auxiliary cathode 14 are viewed in plan view, the center P of the surface 2*s* of the anode 2 corresponds to the center Q of the film formation region 4*r* of the substrate 4, the side of the surface 2*s* of the anode 2 becomes parallel to the corresponding side of the film formation region 4*r* of the substrate 4, and the outer periphery A of the surface 2*s* of the anode 2 is disposed between the substrate 4 and the auxiliary cathode 14.

Next, driving the moving apparatus 52 by inputting the control signal from the control apparatus 50, as illustrated in FIG. 2B, moves the solid electrolyte membrane 6 toward the substrate 4 together with the solution container 12. Thus, while maintaining a positional relation between the anode 2, and the substrate 4 and the auxiliary cathode 14 when viewed in plan view, the end surface 6*s* in the cathode side of the solid electrolyte membrane 6 is brought into contact with the film formation region 4*r* of the surface 4*s* of the substrate 4 and the surface 14*s* of the auxiliary cathode 14.

Next, inputting control signal from the control apparatus 50 closes the on-off valve 40*b*, thereby making the inside of the solution container 12 the closed space to contain the metal ion solution L. Subsequently, in this state, inputting control signal from the control apparatus 50 drives the pump 30*b*, thereby supplying the metal ion solution L to the closed space from the solution tank 30 via the supply pipe 30*a*, thus controlling the fluid pressure, which is measured by the pressure gauge 54, of the metal ion solution L contained in the closed space to a desired value. Furthermore, the power supply device 8 is controlled by inputting the control signal from the control apparatus 50 to apply a voltage between the anode 2, and the substrate 4 and the auxiliary cathode 14 to adjust this voltage to a desired value. Thus, as illustrated in FIG. 2C, while pressurizing the film formation region 4*r* in the surface 4*s* of the substrate 4 by the solid electrolyte membrane 6 with the fluid pressure of the metal ion solution L containing the metal ions disposed between the anode 2 and the solid electrolyte membrane 6, a voltage is applied between the anode 2 and the substrate 4 and the auxiliary cathode 14 such that the auxiliary cathode 14 is at the same potential as that of the substrate (the cathode) 4 to deposit the metal ions contained inside the solid electrolyte membrane 6. Accordingly, the metal film M is formed on the film formation region 4*r* in the surface 4*s* of the substrate 4.

Accordingly, in the film formation apparatus and the film formation method for forming a metal film according to the first embodiment, in order to form the metal film M in the film formation region 4*r* of the surface 4*s* of the substrate (the cathode) 4, when the voltage is applied between the anode 2 and the substrate 4, while the auxiliary cathode 14 is disposed in the peripheral area of the film formation region 4*r* when the surface 4*s* of the substrate 4 is viewed in plan view, a voltage is applied between the anode 2, and the substrate 4 and the auxiliary cathode 14 such that the auxiliary cathode 14 is at the same potential as that of the substrate (the cathode) 4. In view of this, lines of electric force that head for a peripheral edge portion of the film formation region 4*r* of the surface 4*s* of the substrate 4 from the anode 2 without the auxiliary cathode 14 is caused to head for the auxiliary cathode 14 in the peripheral area of the film formation region 4*r*, thereby allowing a suppressed concentration of a current to the peripheral edge portion of the film formation region 4*r* of the surface 4*s* of the substrate 4. Accordingly, since the current density variation in the film formation region 4*r* in the surface 4*s* of the substrate 4 can be suppressed, the metal film M can be formed with a uniform film thickness.

Accordingly, with the film formation apparatus and the film formation method for forming a metal film according to the embodiment, as in the first embodiment, the concentration of the current to the peripheral edge portion of the film formation region in the surface of the substrate can be suppressed, thereby allowing forming the metal film with a uniform film thickness.

Subsequently, a description will be given of the configurations of the film formation apparatus and the film formation method for forming a metal film according to the embodiment in detail.

1. Auxiliary Cathode

The auxiliary cathode is disposed in the peripheral area of the above-described film formation region when the surface of the above-described substrate is viewed in plan view, and has an electric potential lower than that of the above-described anode. The auxiliary cathode has an electric conductivity that allows to suppress the concentration of the current to the peripheral edge portion of the film formation region in the surface of the substrate, and, for example, has a chemical resistance to the solution containing the metal ions.

While the above-described auxiliary cathode is not specifically limited as long as it is a conductive material and an electric potential of it is lower than that of the anode, it is at the same potential as the above-described cathode as the auxiliary cathode according to the first embodiment in some embodiments. This is because the concentration of the current to the peripheral edge portion of the film formation region in the surface of the substrate serving as the cathode can be effectively suppressed. This is also because the application of the electric potential to the substrate and the auxiliary cathode is facilitated. Note that when making the auxiliary cathode be at the same potential as that of the cathode, the cathode and the auxiliary cathode may be grounded.

While the shape of the auxiliary cathode is not specifically limited, as the auxiliary cathode according to the first embodiment, the surface of the auxiliary cathode is parallel to the surface of the anode in some embodiments. While the shape in plan view and the size in plan view of the auxiliary cathode are not specifically limited, usually, they correspond to the shape and the size of the film formation region in the surface of the substrate. Examples of such a shape and size include, for example, one that has a shape in plan view in a rectangular frame shape when the film formation region in the surface of the substrate has a shape in plan view in a rectangular shape as the auxiliary cathode according to the first embodiment.

While the material of the auxiliary cathode is not specifically limited as long as it has an electric conductivity that allows to suppress the concentration of the current to the peripheral edge portion of the film formation region in the surface of the substrate, metal, such as aluminum, is included as an example.

2. Anode

While the anode is not specifically limited as long as it has an electric conductivity that can operate as an anode, for example, it is one that has a chemical resistance to the solution containing the metal ions.

While the shape of the anode is not specifically limited, the surface of the anode is parallel to the end surface in the cathode side of the solid electrolyte as the anode according to the first embodiment in some embodiments. While the shape in plan view and the size in plan view of the anode are not specifically limited, usually, they correspond to the shape in plan view and the size in plan view of the film formation region in the surface of the substrate. This is because the lines of electric force from the anode toward the film formation region can be made uniform, thus allowing formation of the metal film excellent in uniformity of the film thickness. Examples of such a shape and size include one having a shape in plan view similar to the film formation region in the surface of the substrate as the anode according to the first embodiment and a size in plan view slightly smaller or slightly larger than the film formation region in the surface of the substrate, and one having the same shape and size in plan view as the film formation region in the surface of the substrate.

While the material of the anode is not specifically limited, the material of the anode includes a metal having a low ionization tendency compared with the metal of the metal ions (high standard electrode potential compared with the metal of the metal ions), a metal more precious than the metal of the metal ions, and the like. This metal includes, for example, gold.

3. Solid Electrolyte Membrane

The solid electrolyte membrane is disposed between the anode and the substrate that serves as the cathode.

The solid electrolyte membrane contains a solid electrolyte. The solid electrolyte membrane internally contains the metal ions by the contact with the solution containing the metal ions, and the metal ions internally contained in the solid electrolyte membrane are deposited on the surface of the substrate by applying the voltage between the anode and the cathode. While the solid electrolyte membrane is not specifically limited insofar as it is one as described above, the solid electrolyte membrane includes a fluorine-based resin, such as Nafion (registered trademark) manufactured by DuPont, a hydrocarbon resin, a polyamic acid membrane, a membrane with ion exchange function, such as Selemion (CMV, CMD, CMF, and the like) manufactured by AGC Inc., and the like.

4. Solution Container

The solution container contains the solution containing the metal ions (hereinafter referred to as a "metal ion solution" in some cases) between the anode and the solid electrolyte membrane.

While the material of the solution container is not specifically limited insofar as the metal ion solution can be contained between the anode and the solid electrolyte membrane, the material of the solution container has the chemical resistance to the metal ion solution and can shield the lines of electric force in some embodiments.

The metal ion solution is a solution that contains the metal contained in the metal film in the state of the metal ions. While the metal of the metal ions is not specifically limited, copper, nickel, silver, gold, and the like are included. The metal ion solution is obtained by dissolving the metal of the metal ions with an acid, such as nitric acid, phosphoric acid, succinic acid, nickel sulfate, and pyrophosphoric acid.

5. Others

The power supply device applies the voltage between the anode and the cathode. The pressure device pressurizes the solid electrolyte membrane to the cathode side with the fluid pressure of the solution.

While the pressure device is not specifically limited, the pressure device includes, for example, a pump that supplies the metal ion solution to the inside of the solution container, adjusts the fluid pressure of the metal ion solution inside the solution container, and pressurizes the solid electrolyte membrane to the cathode side with the fluid pressure of the metal ion solution, as the pressure device according to the first embodiment.

6. Film Formation Apparatus for Forming Metal Film

A film formation apparatus for forming a metal film includes an anode, a solid electrolyte membrane, a power supply device, a solution container, and a pressure device. The solid electrolyte membrane is disposed between the anode and a substrate that serves as a cathode. The power supply device applies a voltage between the anode and the cathode. The solution container contains a solution between the anode and the solid electrolyte membrane. The solution contains metal ions. The pressure device pressurizes the solid electrolyte membrane to the cathode side with a fluid pressure of the solution. A metal film is formed on a film formation region by applying the voltage while pressurizing the film formation region in the surface of the substrate by the solid electrolyte membrane to deposit the metal ions internally contained in the solid electrolyte membrane. The film formation apparatus for forming a metal film further includes an auxiliary cathode disposed in a peripheral area of the film formation region when a surface of the substrate is viewed in plan view. The auxiliary cathode has an electric potential lower than an electric potential of the anode.

Note that "the film formation region in the surface of the substrate" means a region in which the metal film is formed in the surface of the substrate. The film formation region in the surface of the substrate may be the entire surface of the substrate as the first embodiment or may be a part of the surface of the substrate as a second embodiment described later.

Figure 4:
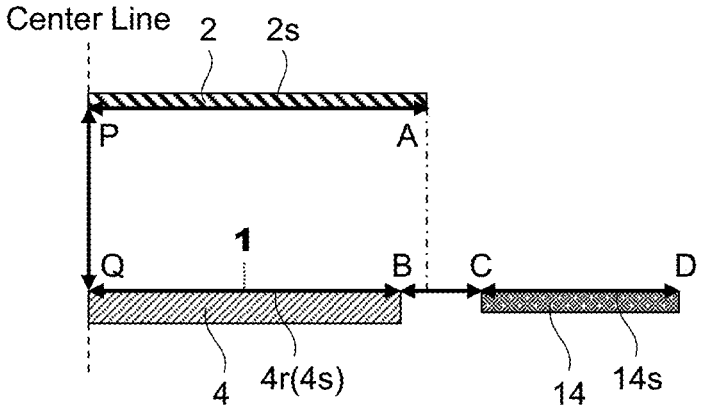
FIG. 4 is a cross-sectional view schematically illustrating one example of dimensions and a positional relation of an anode, a film formation region in the surface of the substrate, and the auxiliary cathode at a film formation by a film formation apparatus for forming a metal film according to the first embodiment.

(1) Dimensions and Positional Relations of Anode, Film Formation Region in Surface of Substrate, and Auxiliary Cathode FIG. 4 is a cross-sectional view schematically illustrating one example of dimensions and a positional relation of the anode, the film formation region in the surface of the substrate, and the auxiliary cathode at the film formation by the film formation apparatus for forming a metal film according to the first embodiment. Specifically, it is a drawing illustrating one example of their dimensions and positional relation when the end surface in the cathode side of the solid electrolyte membrane is brought into contact with the film formation region in the surface of the substrate for forming a metal film in the film formation region in a cross-sectional surface including a direction parallel to one side of the film formation region.

Here, a description will be given of the result of analyzing current density variations in a film formation region 14*r* when the voltage is applied between the anode 2, and the cathode 4 and the auxiliary cathode 14 for forming a metal film M in the film formation region 4*r* in the surface 4*s* of the substrate 4 when the following distances are changed to respective values in the film formation apparatus for forming a metal film according to the first embodiment. The distances are: a distance from the center Q to the outer periphery B (hereinafter referred to as a "Q-B distance" in some cases) of the film formation region 4*r* in the surface 4*s* of the substrate 4 illustrated in FIG. 4; a distance from the center P to the outer periphery A (hereinafter referred to as a "P-A distance" in some cases) in the surface 2*s* of the anode 2; a distance from the outer periphery B of the film formation region 4*r* to the inner periphery C of the surface 14*s* of the auxiliary cathode 14 (hereinafter referred to as a "B-C distance" in some cases); a distance from the inner periphery C to the outer periphery D in the surface 14*s* of the auxiliary cathode 14 (hereinafter referred to as a "C-D distance" in some cases); and a distance from the center P in the surface 2*s* of the anode 2 to the center Q of the film formation region 4*r* (hereinafter referred to as a "P-Q distance").

Figure 5A:
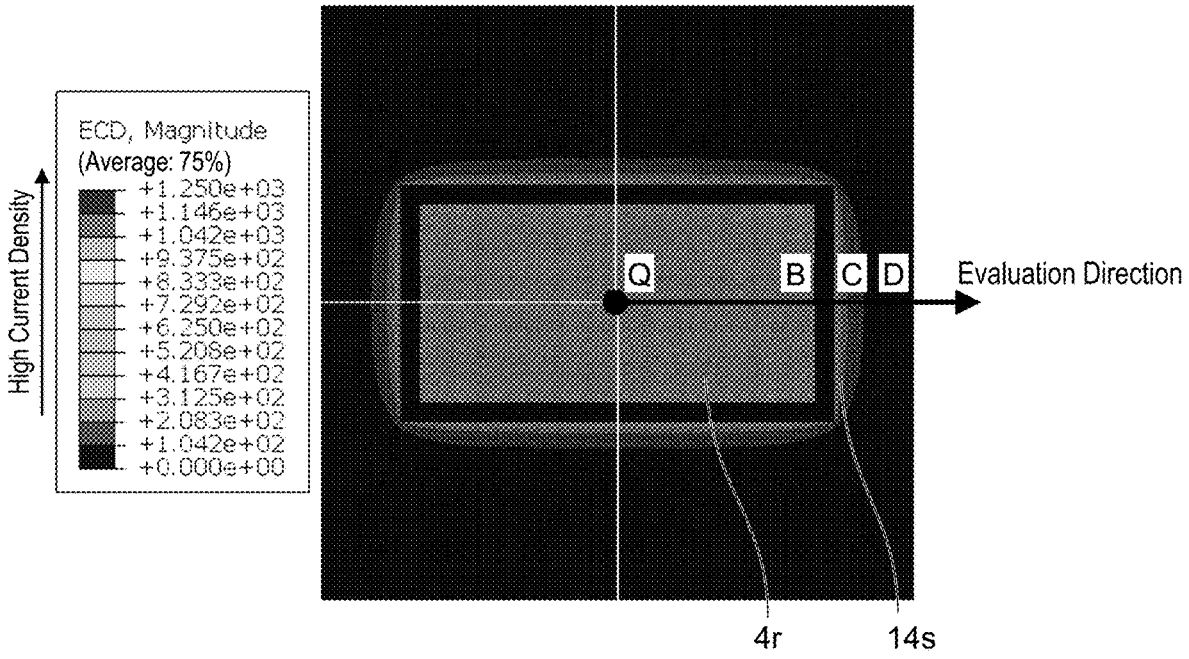
FIG. 5A is an image illustrating a current density distribution in the film formation region and on the surface of the auxiliary cathode analyzed for cases where a P-A distance, a B-C distance, a C-D distance, and a P-Q distance, are varied to relative values in predetermined conditions in the film formation apparatus for forming a metal film according to the first embodiment.
Figure 5B:
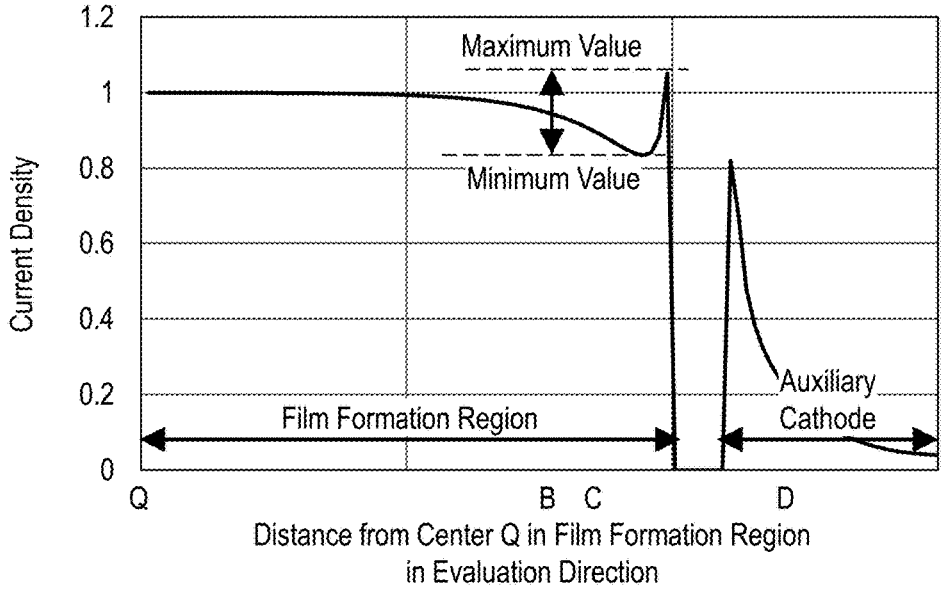
FIG. 5B is a graph illustrating a current density change from a center of the film formation region to the surface of the auxiliary cathode in a direction (an evaluation direction) parallel to one side of the film formation region illustrated in FIG. 5A.

In the analysis of the current density variations, Abaqus produced by Dassault Systemes S.E. was used as software for analysis. First, for cases where the P-A distance, the B-C distance, the C-D distance, and the P-Q distance were changed to relative values under respective conditions illustrated in the following table 1 after the Q-B distance was set to 1 as a standard value of a relative value, current densities at each position in the film formation region 4*r* in the surface 4*s* of the substrate 4 were calculated to analyze a current density distribution in the film formation region 4*r*. FIG. 5A is an image illustrating a current density distribution in the film formation region and the surface of the auxiliary cathode analyzed when the P-A distance, the B-C distance, the C-D distance, and the P-Q distance are changed to relative values under predetermined conditions in the film formation apparatus for forming a metal film according to the first embodiment. FIG. 5B is a graph illustrating a change in current density from the center of the film formation region to the surface of the auxiliary cathode in a direction (an evaluation direction) parallel to one side of the film formation region illustrated in FIG. 5A. In the graph of FIG. 5B, the current density on the vertical axis is represented with the current density in the center of the film formation region as 1. Next, from the analysis result of the current density distribution in the film formation region 4*r* for each condition illustrated in the following table 1, the maximum value and the minimum value of the current density from the center Q to the outer periphery B of the film formation region 4*r* in the direction (the evaluation direction) parallel to the one side of the film formation region 4*r* illustrated in FIG. 5A were used, and "(the maximum value of the current density in the film formation region—the minimum value of the current density of the film formation region)/the current density at the center of the film formation region" was calculated and obtained as the current density variations. The results are illustrated in conjunction in the following table 1.

TABLE 1

| Condition | Q-B Distance [—] | P-A Distance [—] | B-C Distance [—] | C-D Distance [—] | P-Q Distance [—] | Current Density Variation [—] |
|---|---|---|---|---|---|---|
| 1 | 1.00 | 0.95 | 0.05 | 0.05 | 0.10 | 0.59 |
| 2 | 1.00 | 1.15 | 0.05 | 0.05 | 0.10 | 0.80 |
| 3 | 1.00 | 0.95 | 0.15 | 0.05 | 0.10 | 0.54 |
| 4 | 1.00 | 1.15 | 0.15 | 0.05 | 0.10 | 1.37 |
| 5 | 1.00 | 0.95 | 0.05 | 0.15 | 0.10 | 0.60 |
| 6 | 1.00 | 1.15 | 0.05 | 0.15 | 0.10 | 0.52 |
| 7 | 1.00 | 0.95 | 0.15 | 0.15 | 0.10 | 0.54 |
| 8 | 1.00 | 1.15 | 0.15 | 0.15 | 0.10 | 1.28 |
| 9 | 1.00 | 0.95 | 0.05 | 0.05 | 0.30 | 0.40 |
| 10 | 1.00 | 1.15 | 0.05 | 0.05 | 0.30 | 0.74 |
| 11 | 1.00 | 0.95 | 0.15 | 0.05 | 0.30 | 0.39 |
| 12 | 1.00 | 1.15 | 0.15 | 0.05 | 0.30 | 1.01 |
| 13 | 1.00 | 0.95 | 0.05 | 0.15 | 0.30 | 0.48 |
| 14 | 1.00 | 1.15 | 0.05 | 0.15 | 0.30 | 0.38 |
| 15 | 1.00 | 0.95 | 0.15 | 0.15 | 0.30 | 0.43 |
| 16 | 1.00 | 1.15 | 0.15 | 0.15 | 0.30 | 0.75 |
| 17 | 1.00 | 0.88928 | 0.10 | 0.10 | 0.20 | 0.65 |
| 18 | 1.00 | 1.21072 | 0.10 | 0.10 | 0.20 | 0.95 |
| 19 | 1.00 | 1.05 | 0.02 | 0.10 | 0.20 | 0.23 |
| 20 | 1.00 | 1.05 | 0.18 | 0.10 | 0.20 | 0.13 |
| 21 | 1.00 | 1.05 | 0.10 | 0.02 | 0.20 | 0.57 |

TABLE 1-continued

| Condition | Q-B Distance [—] | P-A Distance [—] | B-C Distance [—] | C-D Distance [—] | P-Q Distance [—] | Current Density Variation [—] |
|---|---|---|---|---|---|---|
| 22 | 1.00 | 1.05 | 0.10 | 0.18 | 0.20 | 0.34 |
| 23 | 1.00 | 1.05 | 0.10 | 0.10 | 0.04 | 0.83 |
| 24 | 1.00 | 1.05 | 0.10 | 0.10 | 0.36 | 0.47 |
| 25 | 1.00 | 1.05 | 0.10 | 0.10 | 0.20 | 0.37 |

Subsequently, a description will be given of the result of intended ranges of the P-A distance, the B-C distance, the C-D distance, and the P-Q distance in which the current density variation becomes 0.3 or less, 0.3 of which is a level of variation in the film formation by the conventional plating. The result of intended ranges is obtained by analysis, using the response surface methodology of the design of experiments, from the analysis result of current density variation illustrated in the above-described Table 1.

In the response surface methodology, JUSE-StatWorks (registered trademark) produced by The Institute of Japanese Union of Scientists & Engineers was used as statistics analysis software. With the current density variation used as objective variables (characteristic values) and the P-A distance, the B-C distance, the C-D distance, and the P-Q distance used as explanatory variables, the analysis obtained the intended ranges of their distances in which the current density variation becomes 0.3 or less.

Figure 6:
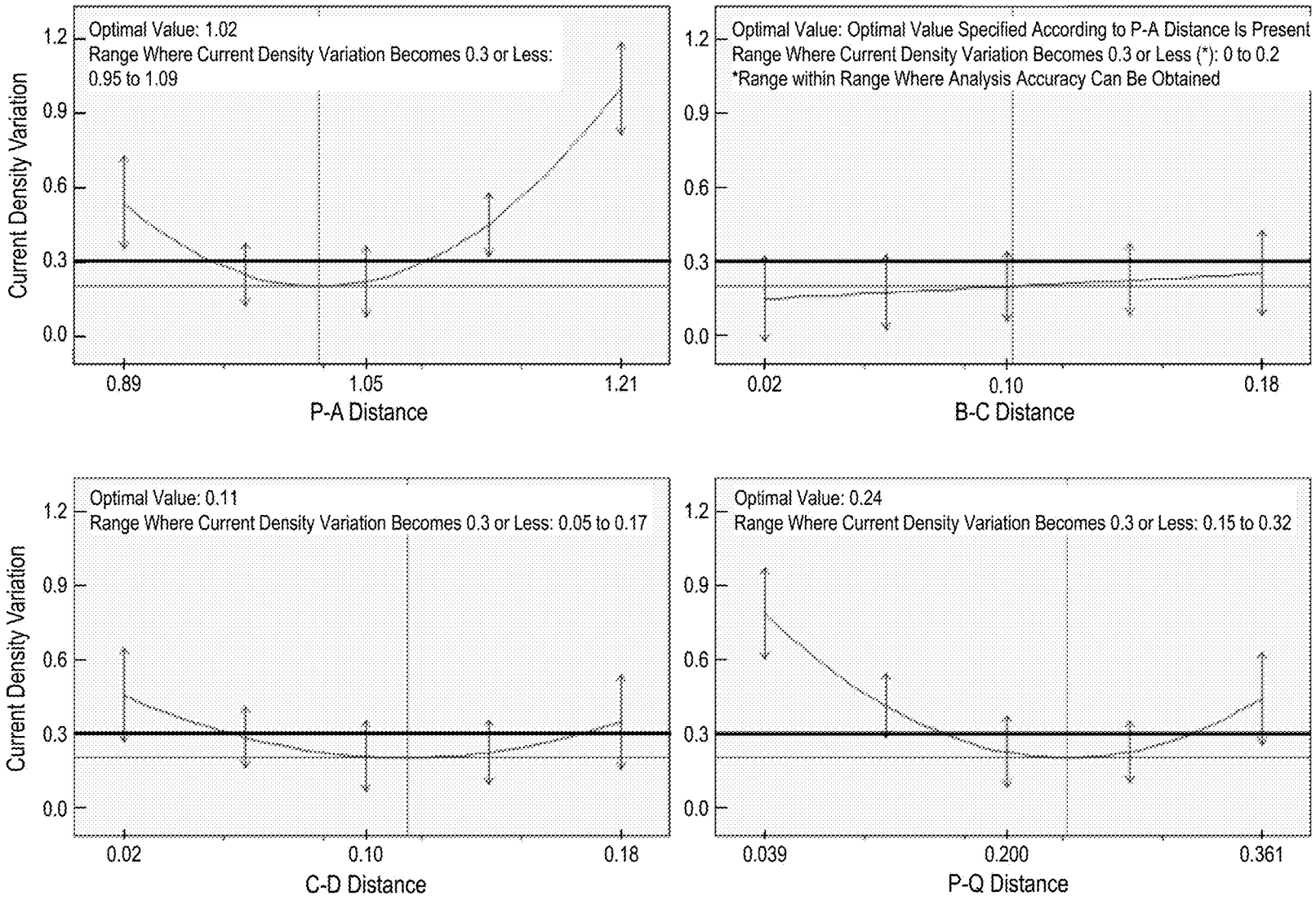
FIG. 6 is a drawing representing four graphs illustrating respective current density variations for the P-A distance, the B-C distance, the C-D distance, and the P-Q distance obtained from analyses using the response surface methodology.
Figure 7:
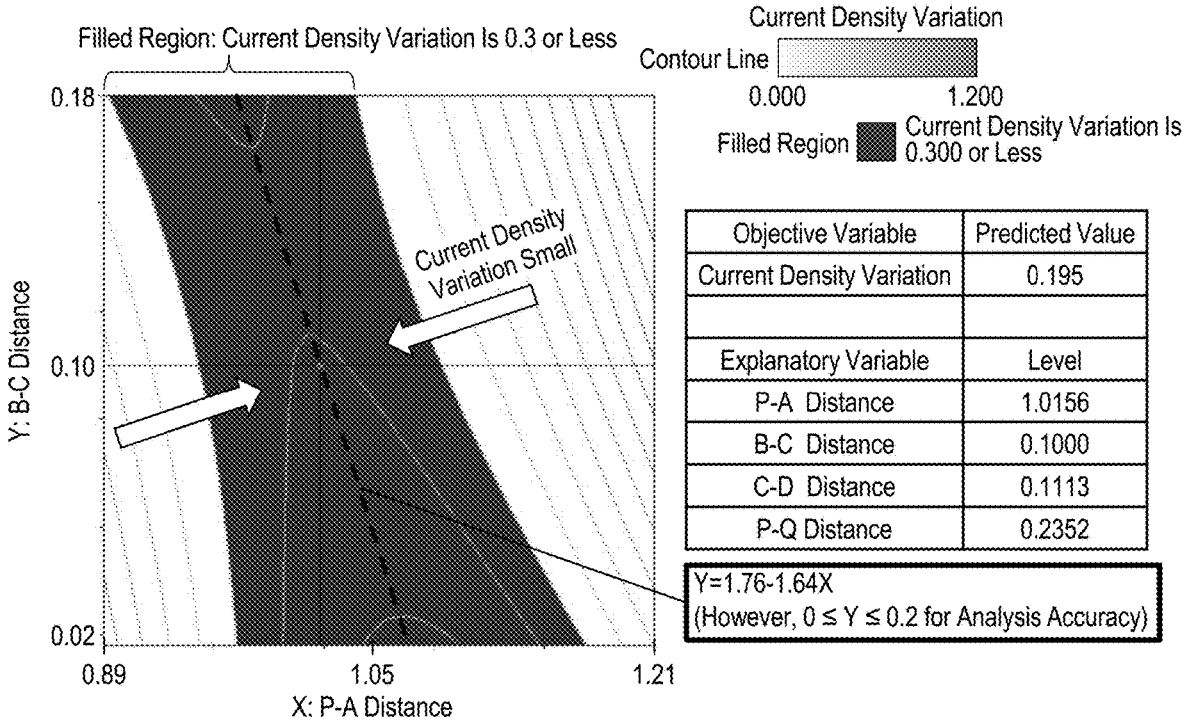
FIG. 7 is a contour plan illustrating current density variation for the P-A distance (X) and the B-C distance (Y) obtained from an analyzation using the response surface methodology.

FIG. 6 is a drawing representing four graphs illustrating current density variations for each of the P-A distance, the B-C distance, the C-D distance, and the P-Q distance obtained by the analysis using the response surface methodology. From the analysis using the response surface methodology, the optimal value of the P-A distance, the optimal value of the C-D distance, and the optimal value of the P-Q distance with which the minimum value of the current density variation was obtained were found to be 1.02, 0.11, and 0.24, respectively, and the optimal value of the B-C distance with which the minimum value of the current density variation was obtained was specified as 0.10 according to the optimal value (1.02) of the P-A distance. In FIG. 6, the graph that illustrates the current density variation for the P-A distance is a graph when the C-D distance and the P-Q distance are set to the optimal values and the B-C distance is set to 0.10. The graph that illustrates the current density variation for the B-C distance is a graph when the P-A distance, the C-D distance, and the P-Q distance are set to the optimal values. The graph that illustrates the current density variation for the C-D distance is a graph when the P-A distance and the P-Q distance are set to the optimal values, and the B-C distance is set to 0.10. The graph that illustrates the current density variation for the P-Q distance is a graph when the P-A distance and the C-D distance are set to the optimal values, and the B-C distance is set to 0.10. FIG. 7 is a contour plan illustrating current density variation for the P-A distance (X) and the B-C distance (Y) obtained by the analysis using the response surface methodology. In FIG. 7, contour lines when the C-D distance and the P-Q distance are set to the optimal values are illustrated, a region in which the current density variation becomes 0.3 or less is illustrated as a filled region, and the minimum value of the current density variation, the optimal value of the P-A distance, the optimal value of the B-C distance, the optimal value of the C-D distance, and the optimal value of the P-Q distance are illustrated in the table.

As illustrated in FIG. 6, by the analysis using the response surface methodology, the intended ranges of the P-A distance, the B-C distance, the C-D distance, and the P-Q distance in which the current density variation becomes 0.3 or less were found to be the P-A distance: 0.95 to 1.09, the B-C distance: 0 to 0.2, the C-D distance: 0.05 to 0.17, and the P-Q distance: 0.15 to 0.32. Note that the intended range of the B-C distance in which the current density variation becomes 0.3 or less is a range where the current density variation in a range where an analysis accuracy can be obtained becomes 0.3 or less. In view of this, the film formation apparatus for forming a metal film has the P-A distance within a range of 0.95 to 1.09, the B-C distance within a range of 0 to 0.2, the C-D distance within a range of 0.05 to 0.17, and the P-Q distance within a range of 0.15 to 0.32 in some embodiments. This is because the current density variation becomes 0.3 or less and the effect that allows the film formation of the metal film with a uniform film thickness becomes remarkable.

As illustrated in FIG. 7, each value of the P-A distance (X) and the B-C distance (Y) with which the current density variation becomes the minimum at each value of the P-A distance (X), satisfy a relational expression of $Y=1.76-1.64X$ (however, $0 \leq Y \leq 0.2$ for analysis accuracy) as represented with the graph by the dashed line. In view of this, the film formation apparatus for forming a metal film, in some embodiments, has the P-A distance (X) and the B-C distance (Y) satisfying the relational expression of $Y=1.76-1.64X$ among ones with the P-A distance within the range of 0.95 to 1.09, the B-C distance within the range of 0 to 0.2, the C-D distance within the range of 0.05 to 0.17, the P-Q distance within the range of 0.15 to 0.32. This is because the current density variation is further reduced and the effect that allows the film formation of the metal film with a uniform film thickness becomes further remarkable.

Figure 8A:
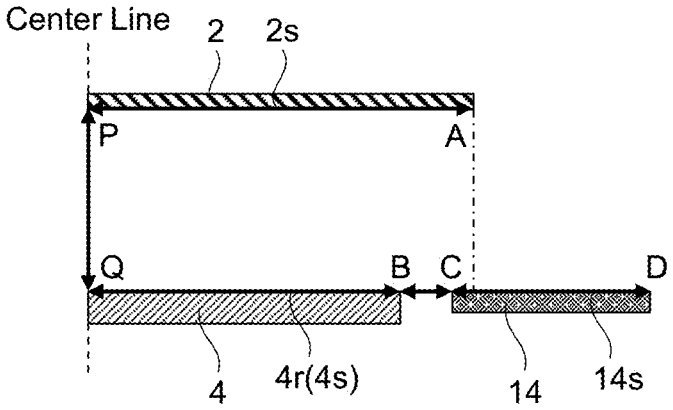
FIG. 8A is a cross-sectional view schematically illustrating another example of dimensions and a positional relation of an anode, a substrate, and an auxiliary cathode of a film formation apparatus for forming a metal film at forming the metal film.
Figure 8B:
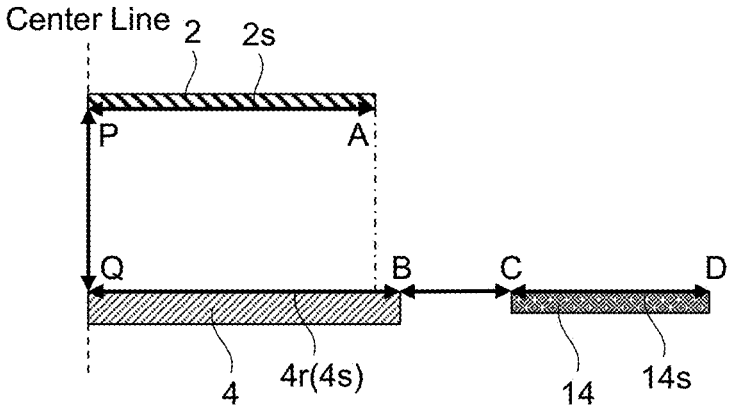
FIG. 8B is a cross-sectional view schematically illustrating another example of dimensions and a positional relation of an anode, a substrate, and an auxiliary cathode of a film formation apparatus of forming a metal film at forming the metal film.

FIG. 8A and FIG. 8B are cross-sectional views schematically illustrating other examples of dimensions and positional relations of the anode, the substrate, and the auxiliary cathode of the film formation apparatus for forming a metal film at the film formation of the metal film. Similarly to FIG. 4, FIG. 8A and FIG. 8B illustrate their dimensions and positional relations when the end surface in the cathode side of the solid electrolyte membrane is brought into contact with the film formation region for forming a metal film in the film formation region in the surface of the substrate.

In the film formation apparatus for forming a metal film, as described above, when the Q-B distance is 1, the P-A distance is within the range of 0.95 to 1.09, and the B-C distance is within the range of 0 to 0.2, making the P-A distance (X) and the B-C distance (Y) satisfy the relational expression of $Y=1.76-1.64X$ (however, $0 \leq Y \leq 0.2$ for analysis accuracy) allows to reduce the current density variation. Accordingly, as illustrated in FIG. 8A, when the P-A distance is increased, the B-C distance is decreased in some embodiments. As illustrated in FIG. 8B, when the P-A distance is decreased, the B-C distance is increased in some embodiments. While the film formation apparatus for forming a metal film may be one that has the outer periphery A of the surface 2*s* of the anode 2 arranged between the substrate 4 and the auxiliary cathode 14 (between B-C) as illustrated in FIG. 4, it may be one that has the outer periphery A of the surface 2*s* of the anode 2 arranged between the inner periphery C to the outer periphery D (between C-D) of the surface 14*s* of the auxiliary cathode 14 as illustrated in FIG. 8A or may be one that has the outer periphery A of the surface 2*s* of the anode 2 arranged between the center Q and the outer periphery B (between Q-B) of the film formation region 4*r* as illustrated in FIG. 8B.

(2) Others

Figure 9:
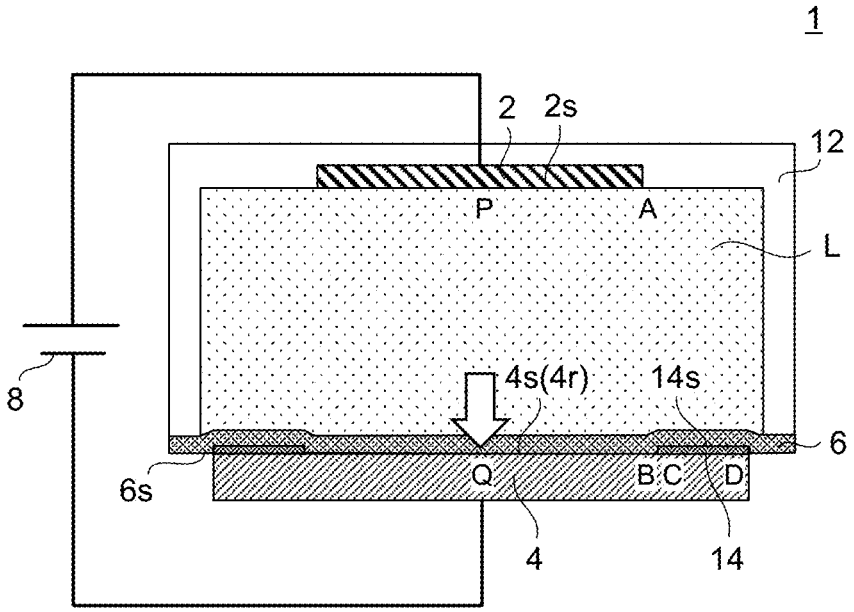
FIG. 9 is a schematic cross-sectional view illustrating a state at a film formation by a film formation apparatus for forming a metal film according to a second embodiment.

FIG. 9 is a schematic cross-sectional view illustrating a state at the film formation of the film formation apparatus for forming a metal film according to the second embodiment. The film formation apparatus for forming a metal film may be one that has the auxiliary cathode in a separate body from the substrate as the film formation apparatus for forming a metal film according to the first embodiment or may be one that has the center side of the surface 4*s* of the substrate 4 serving as the film formation region 4*r* and the auxiliary cathode 14 provided integrally with the substrate such that the auxiliary cathode 14 masks the region in the peripheral area of the film formation region 4*r* in the surface 4*s* of the substrate 4 as the film formation apparatus 1 for forming a metal film according to the second embodiment illustrated in FIG. 9. Even in such film formation apparatus 1, the concentration of the current to the edge portion of the film formation region 4*r* in the surface 4*s* of the substrate 4 can be suppressed. Note that when such a film formation apparatus is used, usually, the auxiliary cathode is removed after the metal film is formed in the film formation region in the surface of the substrate.

Figure 10:
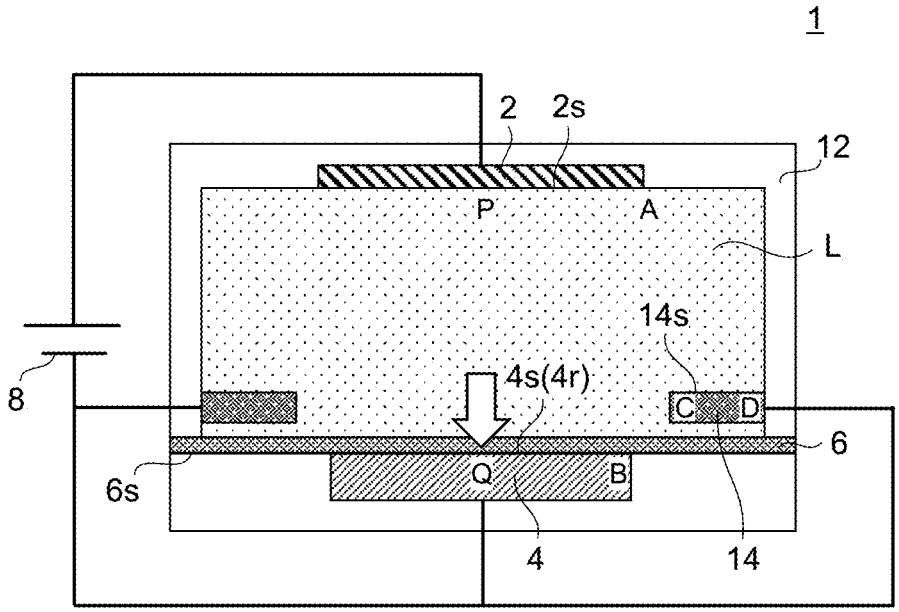
FIG. 10 is a schematic cross-sectional view illustrating a state at a film formation by a film formation apparatus for forming a metal film according to a third embodiment.

FIG. 10 is a schematic cross-sectional view illustrating a state at the film formation of the film formation apparatus for forming a metal film according to a third embodiment. The film formation apparatus for forming a metal film may be one that has the auxiliary cathode 14 disposed at a position inside the solution container 12 close to the anode 2 with respect to the solid electrolyte membrane 6 as the film formation apparatus 1 for forming a metal film according to the third embodiment illustrated in FIG. 10. Even in such a film formation apparatus 1, the concentration of the current to the edge portion of the film formation region 4*r* in the surface 4*s* of the substrate 4 can be suppressed.

7. Film Formation Method for Forming Metal Film

A film formation method for forming a metal film includes disposing a solid electrolyte membrane between an anode and a substrate that serves as a cathode, forming a metal film on a film formation region by applying a voltage between the anode and the cathode while pressurizing the film formation region in the surface of the substrate by the solid electrolyte membrane with a fluid pressure of a solution to deposit metal ions internally contained in the solid electrolyte membrane. The solution is disposed between the anode and the solid electrolyte membrane. The solution contains the metal ions. The metal film is formed by applying the voltage in a state where an auxiliary cathode an electric potential of which is lower than an electric potential of the anode is disposed in a peripheral area of the film formation region when a surface of the substrate is viewed in plan view.

While the film formation method for forming a metal film is not specifically limited as long as the above-described auxiliary cathode has the electric potential lower than that of the anode, as the film formation method for forming a metal film according to the first embodiment, the above-described auxiliary cathode is at the same electric potential as that of the above-described cathode in some embodiments. This is because the concentration of the current to the edge portion of the film formation region in the surface of the substrate serving as the cathode can be effectively suppressed. This is also because the application of the electric potential to the substrate and the auxiliary cathode is facilitated.

The substrate serving as the cathode is not specifically limited as long as it has the electric conductivity that can operate as the cathode and the metal film can be formed in the film formation region in the surface of the substrate, besides the substrate made of metal, such as aluminum, and the substrate in which a metal base layer is disposed on a processing surface, such as a substrate made of resin and a silicon substrate, for example, a substrate with wiring pattern in which a wiring pattern including a plurality of wirings is disposed on a surface of an insulating substrate is included as an example. When the substrate with wiring pattern is used as the substrate serving as the cathode, the metal film is formed on the wiring pattern in the film formation region in the surface of the substrate. This allows to suppress the concentration of the current to the wiring in a peripheral edge portion of the film formation region, thereby allowing to form the wiring pattern obtained by forming the metal film on a plurality of wirings with a uniform film thickness.

While the film formation method for forming a metal film is not specifically limited, for example, a method forms the metal film in the above-described film formation region using the film formation apparatus for forming a metal film according to the embodiment in some embodiments.

While the embodiments of the present disclosure have been described in detail above, the present disclosure is not limited thereto, and can be subjected to various kinds of changes in design without departing from the spirit of the present disclosure described in the claims.

All publications, patents and patent applications cited in the present description are herein incorporated by reference as they are.

DESCRIPTION OF SYMBOLS

1 Film formation apparatus for forming metal film
2 Anode
2*s* Surface of anode
4 Substrate (cathode)
4*s* Surface of substrate
4*r* Film formation region in surface of substrate
6 Solid electrolyte membrane
6*s* End surface in cathode side of solid electrolyte membrane
8 Power supply device
12 Solution container
12*h* Opening of solution container
14 Auxiliary cathode
14*s* Surface of auxiliary cathode
30*b* Pump (pressure device)
L Metal ion solution
M Metal film

What is claimed is:

1. A film formation apparatus for forming a metal film, comprising:

an anode;

a substrate serving as a cathode, the substrate having a film forming region that is located on a surface of the substrate;

an auxiliary cathode;

a solid electrolyte membrane disposed between the anode and the substrate;

a power supply device that applies a voltage between the anode and the cathode;

a solution container that contains a solution between the anode and the solid electrolyte membrane, the solution containing metal ions; and a pressure device that pressurizes the solid electrolyte membrane to the cathode side with a fluid pressure of the solution, wherein the auxiliary cathode is disposed into a frame shape in a peripheral area of the film formation region when the surface of the substrate is viewed in plan view, wherein the auxiliary cathode is provided outside of the solution container, wherein, when a relative value of a Q-B distance from the center Q to the outer periphery B of the film formation region is set to 1 as a standard value, a relative value of a P-A distance from the center P to the outer periphery A in the surface of the anode is within a range of 0.95 to 1.09, a relative value of a B-C distance from the outer periphery B of the film formation region to the inner periphery C of the surface of the auxiliary cathode is within a range of 0 to 0.2, a relative value of a C-D distance from the inner periphery C to the outer periphery D in the surface of the auxiliary cathode is within a range of 0.05 to 0.17, and a relative value of a P-Q distance from the center P in the surface of the anode to the center Q of the film formation region is within a range of 0.15 to 0.32.

2. The film formation apparatus according to claim 1, wherein the auxiliary cathode is at the same electric potential as an electric potential of the cathode.

3. The film formation apparatus according to claim 1, wherein the auxiliary cathode is provided integrally with the substrate such that the auxiliary cathode masks a region in the peripheral area of the film formation region.

4. The film formation apparatus according to claim 1, wherein the surface of the substrate and the surface of the auxiliary cathode are parallel.

5. The film formation apparatus according to claim 1, wherein the surface of the substrate and the surface of the auxiliary cathode are flush with one another.

6. The film formation apparatus according to claim 2, wherein the cathode and the auxiliary cathode are grounded.

7. A method for forming a metal film with the film formation apparatus according to claim 1, the method comprising disposing the solid electrolyte membrane between the anode and the substrate; and forming the metal film on the film formation region by applying a voltage between the anode and the cathode while pressurizing the film formation region in the surface of the substrate by the solid electrolyte membrane with a fluid pressure of the solution to deposit metal ions internally contained in the solid electrolyte membrane, wherein the metal film is formed by applying the voltage such that an electric potential of the auxiliary cathode is lower than an electric potential of the anode.

8. The method according to claim 7, wherein the auxiliary cathode is at the same electric potential as an electric potential of the cathode.

* * * * *